US010155226B2

(12) United States Patent
Frangenberg et al.

(10) Patent No.: US 10,155,226 B2
(45) Date of Patent: Dec. 18, 2018

(54) HARD BODY AS GRID ARMORING FOR A ROLLER PRESS, A METHOD FOR ITS PRODUCTION, AND A ROLLER FOR A ROLLER PRESS

(71) Applicant: TAKRAF GmbH, Leipzig (DE)

(72) Inventors: Meinhard Frangenberg, Kürten-Engeldorf (DE); Karsten Ebenhan, Dresden (DE)

(73) Assignee: TAKRAF GmbH, Leipzig (DE)

( * ) Notice: Subject to any disclaimer, the term of this patent is extended or adjusted under 35 U.S.C. 154(b) by 140 days.

(21) Appl. No.: 15/142,123

(22) Filed: Apr. 29, 2016

(65) Prior Publication Data

US 2016/0318024 A1 Nov. 3, 2016

(30) Foreign Application Priority Data

Apr. 29, 2015 (DE) ..... 10 2015 207 922

(51) Int. Cl.

| | |
|---|---|
| ***B02C 4/00*** | (2006.01) |
| ***B02C 4/30*** | (2006.01) |
| *B02C 4/02* | (2006.01) |

(52) U.S. Cl.

CPC ..... *B02C 4/305* (2013.01); *B02C 4/02* (2013.01); *B02C 2210/02* (2013.01)

(58) Field of Classification Search

CPC ..... B02C 4/02; B02C 4/305

USPC ..... 241/294, 300

See application file for complete search history.

(56) References Cited

U.S. PATENT DOCUMENTS

| | | | | |
|---|---|---|---|---|
| 4,145,213 | A | 3/1979 | Oskarsson et al. | |
| 7,028,936 | B2 * | 4/2006 | Condon | B02C 13/1814 241/275 |
| 7,607,601 | B2 * | 10/2009 | Rodriguez | B02C 13/2804 241/275 |

(Continued)

FOREIGN PATENT DOCUMENTS

| | | | |
|---|---|---|---|
| DE | 102006024358 | A1 | 11/2007 |
| DE | 102011104854 | A1 | 12/2012 |

(Continued)

OTHER PUBLICATIONS

Office Action issued in Australian Patent Application No. 2016202395, (Australian Counterpart of U.S. Appl. No. 15/142,123) dated Oct. 27, 2016.

European Search Report issued by the European Patent Office in European counterpart application Ep 16 167 477.5 (dated Oct. 6, 2016).

(Continued)

*Primary Examiner* — Faye Francis

(74) *Attorney, Agent, or Firm* — FisherBroyles, LLP; Andrew K. Gonsalves, Esq.

(57) ABSTRACT

The present invention relates to a wear-resistant hard body that includes, at least partially, a high-strength, iron-based alloy, and preferably includes an external shell or sleeve made of another material. The hard body can be made by casting a molten iron-based alloy into the shell or the sleeve. The iron-based alloy can be an FeCrMoVC alloy. The shell or sleeve can be made of steel, copper, or a copper alloy. Methods for producing the wear-resistant hard body or for producing hard bodies or side-wear protection elements for a roller of a roller press are also disclosed. A roller for a roller press that includes at least one wear-resistant hardy body as described herein is also disclosed.

14 Claims, 4 Drawing Sheets

(56) References Cited

U.S. PATENT DOCUMENTS

| | | | | |
|---|---|---|---|---|
| 7,909,279 | B2 * | 3/2011 | Condon | B02C 13/1814 241/275 |
| 9,492,827 | B2 * | 11/2016 | Daniels | B02C 4/08 |
| 2007/0215733 | A1 * | 9/2007 | Splinter | B02C 4/30 241/221 |
| 2011/0008569 | A1 | 1/2011 | Madok et al. | |
| 2012/0073105 | A1 | 3/2012 | Botto et al. | |
| 2012/0312907 | A1 * | 12/2012 | Gronvall | B02C 4/305 241/30 |
| 2014/0326811 | A1 * | 11/2014 | Daniels | B02C 4/08 241/27 |
| 2015/0034749 | A1 * | 2/2015 | De Weldige | B02C 4/305 241/220 |
| 2017/0043349 | A1 * | 2/2017 | Guerard | B22D 19/02 |

FOREIGN PATENT DOCUMENTS

| | | | |
|---|---|---|---|
| EP | 2239058 | A2 | 10/2010 |
| WO | 2011072754 | A1 | 6/2011 |
| WO | 2016/150719 | A1 | 9/2016 |

OTHER PUBLICATIONS

Second Examination Report issued in Australian Patent Application No. 2016202395 (Australian Counterpart of U.S. Appl. No. 15/142,123), dated Apr. 6, 2017.

Russel et al., "Microstructural and fracture toughness characterisation of a high-strength FeCrMoVC alloy manufactured by rapid solidification," Engineering Fracture Mechanics, 99:278-294 (2013).

* cited by examiner

HARD BODY AS GRID ARMORING FOR A ROLLER PRESS, A METHOD FOR ITS PRODUCTION, AND A ROLLER FOR A ROLLER PRESS

CROSS-REFERENCE TO RELATED APPLICATIONS

This application claims priority benefit under 35 U.S.C. § 119 of German Patent Application No. 10 2015 207 922.8, filed Apr. 29, 2015, the entire contents of which are incorporated herein by reference.

FIELD OF THE INVENTION

The present invention relates to a hard body for the grid armoring for a roller of a roller press, a method for its production, and a roller for a roller press.

BACKGROUND OF THE INVENTION

A roller press, also referred to as a material-bed grinding roll, has two rollers between which a bed of material is comminuted by means of a high pressure. The high pressure thereby causes high wear of the rollers. Various solutions have been proposed to reduce this wear.

In principle, surface profiling of rollers is acknowledged to be wear-reducing, whereby profiling may be applied in a number of ways. For example, EP 0443195 A1 proposes the application of burls on the roller surface by welding.

DE 10 2010 024 221 A1 proposes a bandage for a roller press consisting of a high-chromium ferrous alloy. The bandage is formed with a profiled external surface to improve wear protection. Besides the high costs of the alloy, applying the bandage is a complicated process step, resulting in high total costs.

DE 41 32 474 A1 proposes that wear-resistant pieces of material, which are harder than the surrounding rolling material, be embedded in the roller surface. The material pieces are preferably plate- or pin-shaped, connected to the roller by means of bonding and made of carbide. The cost of the carbide material pieces is high, which is a disadvantage, and moreover, carbide is too wear-resistant and brittle for various application purposes.

Document EP 2239058 A2 discloses a wear-resistant roller and its production. The roller includes a plurality of wear-resistant surface elements, preferably bolts, the free bolt ends protruding radially from the surface of the roller. The spaces between the bolts are filled with a matrix material that is softer than the bolts and ground material is refilled on [top of] the matrix material. The bolts are welded on the roller and consist, at least partially, of a high-strength ferrous alloy. A disadvantage is the complex and costly manufacturing process for the device.

DE 10 2011 104 854 A1 proposes to place the hard bodies in a sleeve and insert them into the roller surface. This allows for the hard bodies to be released from the roller surface in an easier way.

The present invention is directed to addressing these and other deficiencies in the art.

SUMMARY OF THE INVENTION

The present invention relates to a hard body for the grid armoring for a roller of a roller press, a method for its production, and a roller for a roller press.

As set forth herein, numerals associated with various aspects of the present invention are as described in Table 1 herein.

In one aspect, the present invention provides a hard body (1) as grid armoring for a roller of a roller press, characterized in that the hard body (1) consists at least partially of a high-strength, iron-based alloy (IFW) and comprises a shell (2) or sleeve made of another material, in particular steel, copper or a copper alloy on the outer surface.

In one embodiment, the present invention provides a hard body (1) as grid armoring for a roller of a roller press according to the present invention, characterized in that the hard bodies (1) have a circular cylindrical shape, wherein the front end of the hard body (1) facing the middle of the roller has a conical or rounded shape.

In one embodiment, the present invention provides a hard body (1) as grid armoring for a roller of a roller press according to the present invention, characterized in that the shell (2) is a unilaterally closed hollow cylinder with a circular cross section and the closed front end is formed hemispherically.

In one embodiment, the present invention provides a hard body (1) as grid armoring for a roller of a roller press according to the present invention, characterized in that the shell (3) has an internal projection, such that between the shell (3) and the hard body (1), a positive fit connection is created.

In one embodiment, the present invention provides a hard body (1) as grid armoring for a roller of a roller press according to the present invention, characterized in that the shell (4) externally has a slot for an external annular spring (5).

In one embodiment, the present invention provides a hard body (1) as grid armoring for a roller of a roller press according to the present invention, characterized in that the shell (4) comprises a recess on its closed front end.

In one embodiment, the present invention provides a hard body (1) as grid armoring for a roller of a roller press according to the present invention, characterized in that the hard body (1) axially and centrally has a core made of a weldable material.

In one embodiment, the present invention provides a hard body (1) as grid armoring for a roller of a roller press according to the present invention, characterized in that the shell (2) or sleeve has an external profiling.

In one embodiment, the present invention provides a hard body (1) as grid armoring for a roller of a roller press according to the present invention, characterized in that the high-strength ferrous alloy is FeCrMoVC.

In another aspect, the present invention provides a roller for a roller press comprising at least one hard body (1) according to the present invention.

In one embodiment, the present invention provides a roller for a roller press according to the present invention, characterized in that the wear-resistant hard bodies (1) are adhesively bonded into holes in the bandage of the roller that fit.

In one embodiment, the present invention provides a roller for a roller press according to the present invention, characterized in that the wear-resistant hard bodies (1) are pressed into the holes in the bandage of the roller.

In one embodiment, the present invention provides a roller for a roller press according to the present invention, characterized in that the roller comprises side-wear protection elements implemented as hard bodies (1) made of a high-strength ferrous alloy (IFW).

In another aspect, the present invention provides a method for producing a wear-resistant hard body (1) according to the present invention, characterized in that in order to mold the hard body (1), a shell or sleeve is placed in a divided casting enclosure, into which the alloy melt is filled.

In one embodiment, the present invention provides a method for producing a wear-resistant hard body (1) according to the present invention, characterized in that the casting enclosure is liquid-cooled.

In another aspect, the present invention provides for the use of a high-strength, iron-based alloy (IFW) for the production of hard bodies (1) or side-wear protection elements for the roller of a roller press.

These and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating aspects of the present invention, there are depicted in the drawings certain embodiments of the invention. However, the invention is not limited to the precise arrangements and instrumentalities of the embodiments depicted in the drawings. Further, if provided, like reference numerals contained in the drawings are meant to identify similar or identical elements.

DETAILED DESCRIPTION OF THE INVENTION

Figure 1:
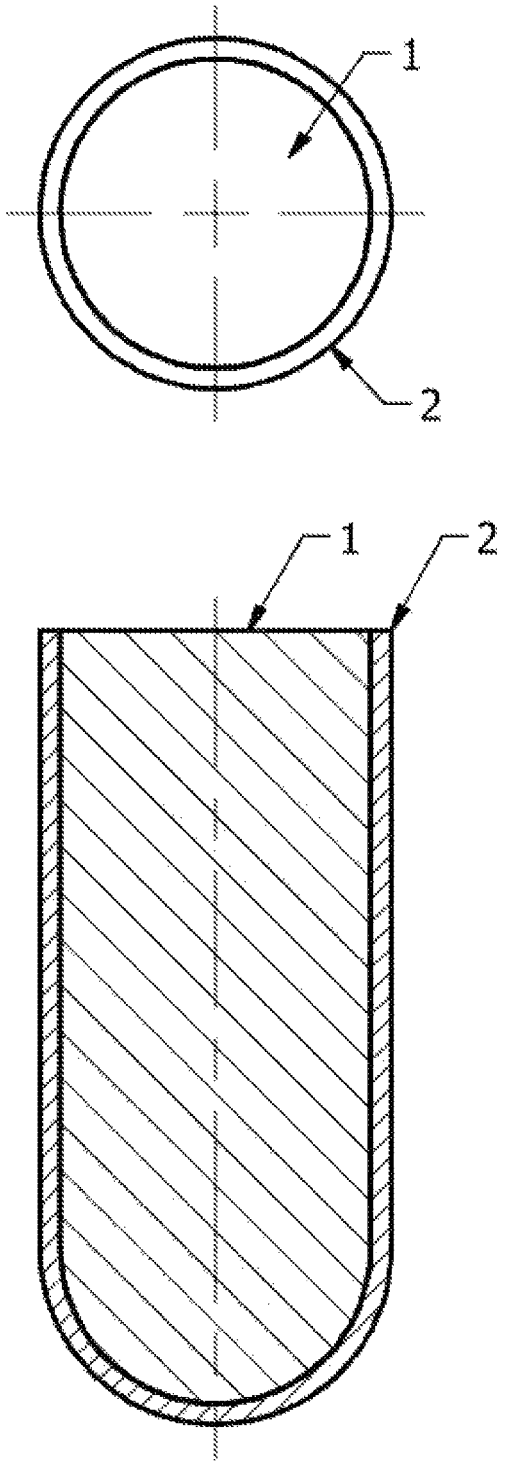
FIG. 1 is a drawing of a hard body according to one embodiment of the present invention comprising a shell.

In order to solve the various noted problems in the prior art, the present invention provides an alternative grid armoring for a roller of a roller press that is inexpensive and has a long service life. Therefore, the present invention provides, inter alia, a hard body for the grid armoring for a roller of a roller press, a method for its production, and a roller for a roller press.

According to the present invention, the deficiencies in the art are solved by a wear-resistant hard body according to the present invention, a roller for a roller press according to the present invention, by a method of producing a hard body according to the present invention, and by implementing the various aspects of the present invention. Preferred aspects of the invention are described herein and in the claims.

The wear-resistant hard body according to the invention consists, at least partially, of a high-strength, iron-based alloy (IFW), and comprises an external shell or sleeve made of another material. Roller press rollers usually have a bandage, often referred to as a roller body, in which the hard bodies are inserted as grid armoring.

Particularly preferably, the hard body has a trilaterally closed external shell. As an advantage, the hard body therefore hardly needs any processing in order to ensure that it fits into the hole in the bandage, as the shell already does. Thus, a defined fit between the bandage and the shelled hard body is made possible. The inventive hard bodies with a shell or a sleeve are also referred to as bimetallic studs.

Particularly preferably, the wear-resistant hard bodies furthermore have a circular cylindrical shape. The closed front end of the shell, which in the installed state is facing the center of the roller, is thereby preferably shaped in a rounded fashion. Advantageously, cracking of the bandage caused by sharp edges is thus prevented. Especially preferably, the rounding has a spherical shape.

In the context of this patent application, the high-strength, iron-based alloy (IFW) is understood to be a high-strength ferrous alloy consisting of a material of the compound according to the formula $Fe_a\ E1_b\ E2_c\ E3_d\ E4_e$. Here, E1 represents one or more elements of the group Cr, V, Mn, Co and Ni, E2 represents one or more elements of the group Mo, Nb, Zr, Y, Hf, Ti, Ta, and W, E3 represents one or more elements of the group Sn, Al, Ga, and Pb, and E4 represents one or more elements of the group Si, P, C and B, where a=100−(b+c+d+e), b=1 to 12, c=1 to 12, d=0 to 12, e=1 to 25 (a, b, c, d, e in atom %). Small amounts of additives and contaminants may thereby be contained as a result of the manufacturing process. 30-90 vol % of the structure of the molded bodies produced from an alloy consists of at least one microcrystalline austenitic, cubic, face-centered (cfc) phase, containing at least one additional microcrystalline phase. The alloy according to the invention is described in DE 10 2006 024 358. The hard bodies are preferably produced by casting into the shell or sleeve made of another material, preferably copper, copper alloys or steel.

Especially advantageous material properties can be achieved, when the hard bodies are produced according to the process described in DE 10 2010 062 011 B3. This process stipulates that after mixing of the alloying elements and their melting, they are poured into a mold, which allows for a cooling rate of at least 10 K/s. Subsequently, the material is tempered at least twice in immediate succession, at tempering temperatures between 500° C. and 600° C., and holding times between 30 seconds and 15 minutes during tempering. The heating and cooling rates should be at least 15 K/min.

In a further preferred embodiment, the shell of the hard body has means allowing for a mounting structure, such as welding lugs or a thread. Advantageously, the hard body can be safely mounted in the roller or at the roller edges. Such a mounting structure would be difficult to realize on a hard body. Other options include a recess or circumferential groove for introducing an annular spring. Such a hard body would be removable by welding on a tab, or the like, for a slide hammer. After driving a hard body into the hole of the roller, the spring produces a force-locking connection. More preferably, the shell comprises a profiling of the external surface of the hard body, allowing the roller to be press-fitted into the roller of the roller press, similar to a grooved pin.

Moreover, the hard bodies preferably have a core made of a weldable material, especially steel, which makes it possible to weld on a means for facilitating the removal of the hard body from the roll.

Preferably, between the shell and/or sleeve and the part of the hard body contained therein, a form-fitting connection is present. This will prevent the shell from releasing due to large temperature fluctuations or other effects.

A recess in the outer casing of the shell or sleeve, in particular at the front end of the hard body, which in the installed state is facing the center of the roller, is likewise preferable. The recess allows venting of the cavity during insertion into the narrow tolerances of the mounting hole of the roller tube, thereby facilitating the introduction of the roller tube into the holes.

As an alternative to press fitting, the wear-resistant hard bodies are adhesively bonded in the holes of the roller. The use of a shell or a sleeve makes it possible to achieve a defined bonding gap. An adhesive reservoir often forms at the bottom of the hole, which has an adverse hydraulic effect. Bonding also unnecessarily prolongs the manufacturing process, as the hard bodies can be bonded only after shrink-fitting of the bandage, or else the adhesive might burn. Finally, omitting an adhesive is environmentally friendly. At any rate, the adhesive compound is crushed during the initial rotation of the rollers.

The high tolerances during the machining of hard bodies cause the formation of a large bonding nip or a negative allowance, through which the hard bodies can be press-fitted only with great force, when bonding on the roller without the shell or sleeve.

Particularly preferred is the high-strength ferrous alloy (IFW) FeCrMoVC. The benefit of this material is primarily the advantageous combination of great hardness and strength, combined with a high ductility. Thus, a high resistance to abrasive and impact stresses can be expected. Furthermore, this material affords the option of becoming independent of tungsten, a strategic material, and reducing the costs, while also reducing the production effort. The inventive roller for a roller press has at least one of the above-described hard bodies as grid armoring.

In a preferred embodiment, the roller press roller comprises side-wear protection elements, which are likewise made of a high-strength, iron-based alloy (IFW). Side-wear protection elements are then armoring elements in the area of the transition from the outer surface to the front end of the roller. It may also be advantageous to design the mold, such that it allows for a mounting structure, e.g., welding or a thread, which is difficult to realize on a hard body, in order to securely fasten this structure on the roller edges.

The inventive method relates to primary shaping of the wear-resistant hard bodies. Here, primary shaping of the wear-resistant hard bodies is done in a closed shell or sleeve, as a mold. For this purpose, the mold is inserted into a preferably cooled casting enclosure and subsequently filled with the molten alloy. The shell preferably has a circular cylindrical cross-section with a hemispherical end. Moreover, the casting enclosure of the mold is preferably divided, which makes it easier to remove the workpiece in an advantageous fashion.

Moreover, the exterior of the cast shell, i.e., with a circular cross-sectional shape of the outer diameter, preferably matches the fit of the wear-resistant hard bodies in the bandage of the roller. Advantageously, reworking of the wear-resistant hard bodies following primary shaping, which is highly complex due to the materials properties, can thus largely be omitted.

Referring to the drawings, various aspects of the present invention are illustrated in the embodiments shown in FIGS. 1, 2, 3, and 4. In referring to the drawings, various reference numerals are used, as set forth in Table 1 below.

TABLE 1

List of Reference Numerals Used in the Drawings

| Reference Numeral | Description of Element |
|---|---|
| 1 | Hard Body |
| 2 | Shell |
| 3 | Shell with a Taper |
| 4 | Shell with a Circumferential Groove |

TABLE 1-continued

List of Reference Numerals Used in the Drawings

| Reference Numeral | Description of Element |
|---|---|
| 5 | Annular Spring |
| 6 | Core |
| 7 | Bilaterally Opened Shell |

FIG. 1 shows a hard body 1 according to one embodiment of the invention made of a high-strength, iron-based alloy, i.e., FeCrMoVC in a unilaterally closed, hollow cylindrical shell 2 made, e.g., of copper. For the manufacture of the hard body 1, the shell 2 is placed in a two-section, coolable housing and the enclosure closed. The melt of the alloy according to the invention FeCrMoVC is then filled with the alloy FeCrMoVC inside the enclosure 1, 2. This is followed by annealing, whereby the hard body 4 is heated twice in succession in the shell 2 for 10 minutes to a temperature of 600° C.

Figure 2:
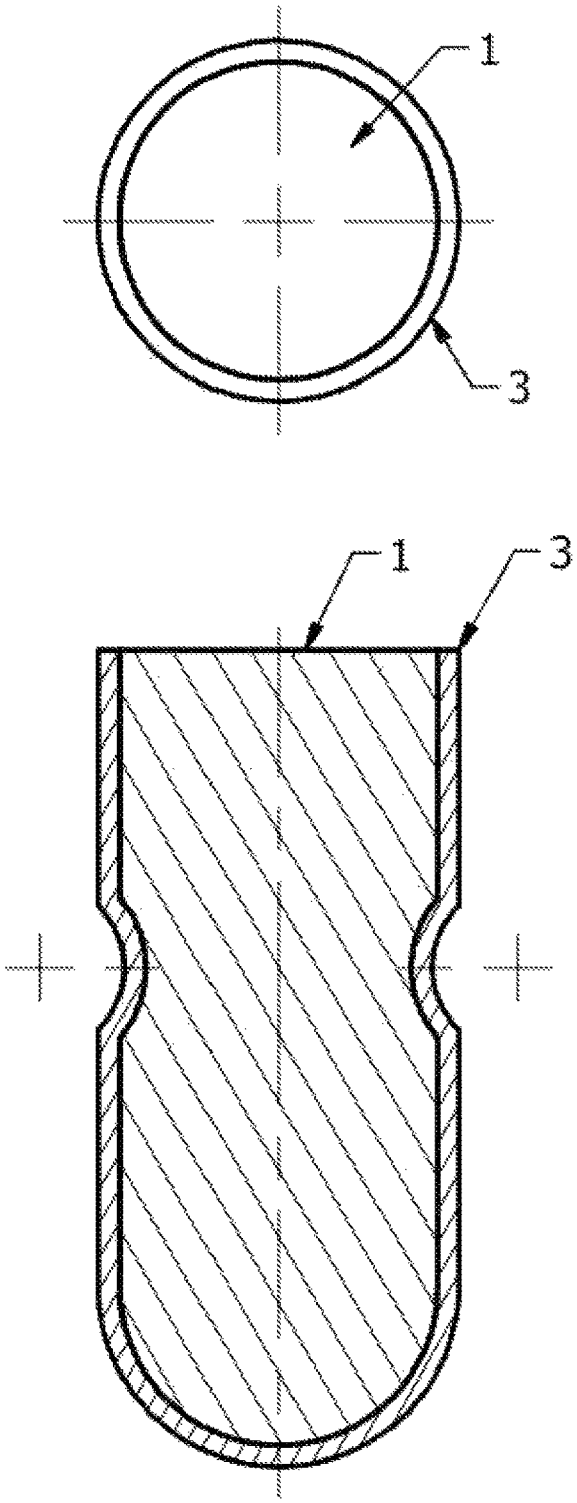
FIG. 2 is a drawing of a hard body according to one embodiment of the present invention comprising a shell and a taper.

FIG. 2 shows a hard body 1 according to one embodiment of the invention with a shell 3 incorporating a taper. The tapering provides a positive locking fit of the hard body 1 in the shell 3, whereby the hard body can be prevented from falling out of the shell 3.

Figure 3:
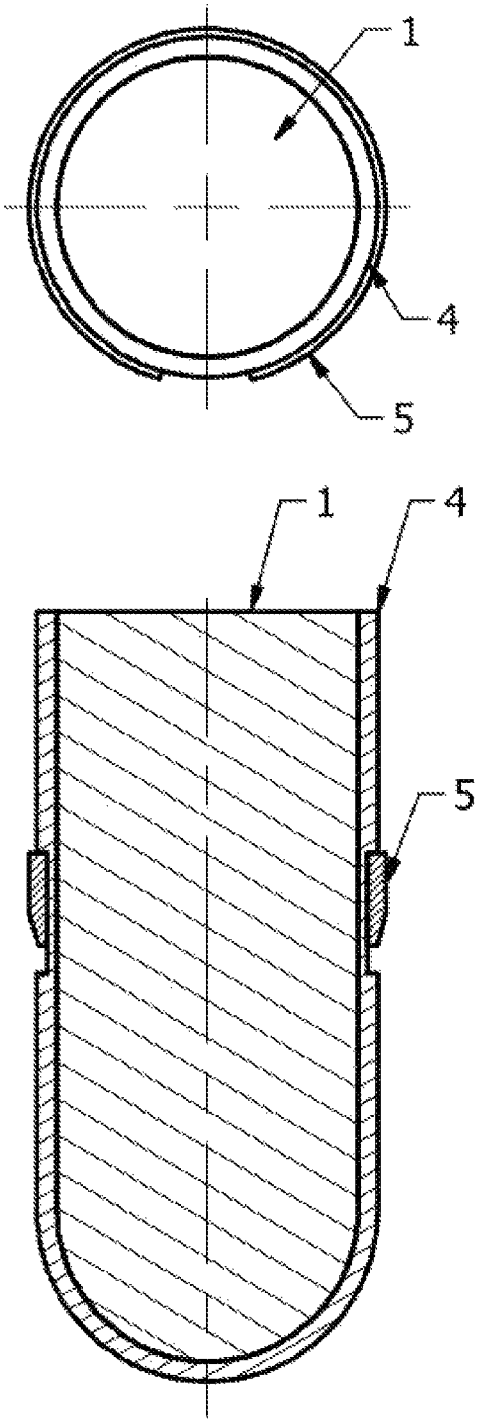
FIG. 3 is a drawing of a hard body according to one embodiment of the present invention comprising a shell and an annular spring.

FIG. 3 likewise shows a hard body 1 according to one embodiment of the invention with a shell 4 comprising a circumferential annular groove in which an annular spring 5 is arranged. The annular spring 5 is able to prevent the release of the shell 4 from the roller bandage. To remove a hard body 1 with a shell 4 with an annular spring 5, a tab is welded onto the shell 4 and the hard body 1 is extracted at this tab with a slide hammer.

Figure 4:
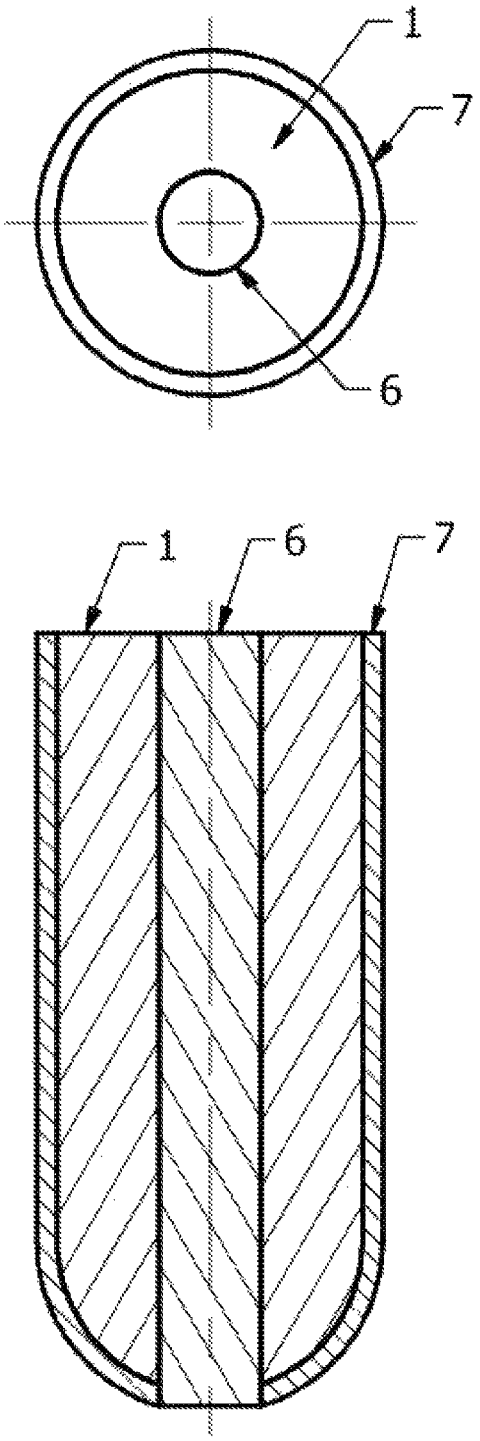
FIG. 4 is a drawing of a hard body according to one embodiment of the present invention comprising a steel core.

FIG. 4 shows a hard body 1 with an inner core 6 made of steel. This core 6 allows for easy removal, in that a means may be welded onto the core 6, whereby the hard body 1 along with shell 7 may be extracted from the roller bandage in a simple fashion.

As set forth herein, embodiments of the present invention discussed herein have been described by way of example in this specification. Having thus described the basic concept of the invention, it will be rather apparent to those of ordinary skill in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and the scope of the invention. Additionally, the recited order of processing elements or sequences, or the use of numbers, letters, or other designations therefore, is not intended to limit the claimed processes to any order, except as may be specified in the claims. Accordingly, the invention is limited only by the following claims and equivalents thereto.

What is claimed is:

1. Grid armoring for a roller of a roller press, said grid armoring comprising a hard body having a front end and a back end and a shell formed on an outer surface of the hard body, wherein the hardy body consists at least partially of a high-strength, iron-based alloy comprising a compound according to the formula $Fe_a\ E1_b\ E2_c\ E3_d\ E4_e$, wherein E1 is one or more elements of the group Cr, V, Mn, Co and Ni, wherein E2 is one or more elements of the group Mo, Nb, Zr, Y, Hf, Ti, Ta, and W, wherein E3 is one or more elements of the group Sn, Al, Ga, Pb, and wherein E4 is one or more elements of the group Si, P, C and B, with content ranges (a, b, c, d, e in atom %) comprising a=100−(b+c+d+e), b=1 to 12, c=1 to 12, d=0 to 12, e=1 to 25, and wherein the shell is made of another material than the hard body, and wherein the hard body is made by casting the molten iron-based alloy into the shell.

2. The grid armoring according to claim 1, wherein the hard body has a circular cylindrical shape, and wherein the front end of the hard body has a conical or rounded shape.

3. The grid armoring according to claim 2, wherein the shell is a unilaterally closed hollow cylinder with a circular cross section and has a closed front end that is formed hemispherically.

4. The grid armoring according to claim 3, wherein the shell has an internal projection, such that between the shell and the hard body, a positive fit connection is created.

5. The grid armoring according to claim 3, wherein the shell externally has a slot for an external annular spring.

6. The grid armoring according to claim 3, wherein the shell comprises a recess on its closed front end.

7. The grid armoring according to claim 3, wherein the hard body axially and centrally has a core made of a weldable material.

8. The grid armoring according to claim 1, wherein the shell has an external profiling.

9. The grid armoring according to claim 1, wherein the high-strength, iron-based alloy is FeCrMoVC.

10. The grid armoring according to claim 1, wherein the shell is made of steel, copper or a copper alloy.

11. A roller for a roller press comprising at least one grid armoring according to claim 1.

12. The roller according to claim 11, wherein the at least one grid armoring is adhesively bonded into holes in a bandage of the roller that fit.

13. The roller according to claim 11, wherein the at least one grid armoring is pressed into holes in a bandage of the roller.

14. The roller according to claim 11, wherein the roller comprises side-wear protection elements implemented as hard bodies made of a high-strength ferrous alloy.

* * * * *